US005426788A

United States Patent [19]

Meltzer

[11] Patent Number: 5,426,788

[45] Date of Patent: Jun. 27, 1995

[54] RING-LIKE HEADWEAR ORNAMENT

[75] Inventor: Faith M. L. Meltzer, Ambler, Pa.

[73] Assignee: U.S.A. Knitting Co., Inc., Philadelphia, Pa.

[21] Appl. No.: 219,595

[22] Filed: Mar. 29, 1994

[51] Int. Cl.[6] ..... A42C 5/00

[52] U.S. Cl. ..... 2/171; 2/207; 2/DIG. 11

[58] Field of Search ..... 2/1, 171, 174, 207, 2/311, DIG. 11; 59/78, 79.1, 80, 82, 83; 63/3, 4, 5.1, 11; 87/13; 132/273, 275; D2/894, 895; D11/3, 4, 5, 6, 93

[56] References Cited

U.S. PATENT DOCUMENTS

| | | | |
|---|---|---|---|
| 568,531 | 9/1896 | Harthan | 59/83 |
| 2,840,983 | 7/1958 | Keilbach | 63/11 |
| 5,073,989 | 12/1991 | Teague | 2/DIG. 11 |

*Primary Examiner*—Clifford D. Crowder
*Assistant Examiner*—Diana L. Biefeld
*Attorney, Agent, or Firm*—Caesar, Rivise, Bernstein, Cohen & Pokotilow, Ltd.

[57] ABSTRACT

An ornament, e.g., a hair band, headband, hat band, etc., and method of making it. The ornament comprises a plurality of looped links and a looped connecting member. Each of the looped links is formed of an flexible, somewhat elastic, e.g., knitted, material in the nominal shape of a toroidal loop, but bent into a shape having a bridging midsection and a pair of openings on each side of the bridging midsection. The looped connecting member is in the form of a loop of the same material and has a central opening. The looped links are interconnected with one another so that the bridging midsection of one looped link extends through the openings in the immediately adjacent looped link to form an elongated chain-link strip having a pair of ends. One of the ends of the chain-linked strip comprising the looped connecting member and the other end comprises the looped link forming that end. The looped connecting member is extended through the open ends of the looped link forming the other end of the chain-linked strip and is folded back over itself and secured, e.g, glued, to a portion of it to convert the chain-link strip into a ring. The looped connecting member simulates the shape of the other looped links of the ring.

17 Claims, 3 Drawing Sheets

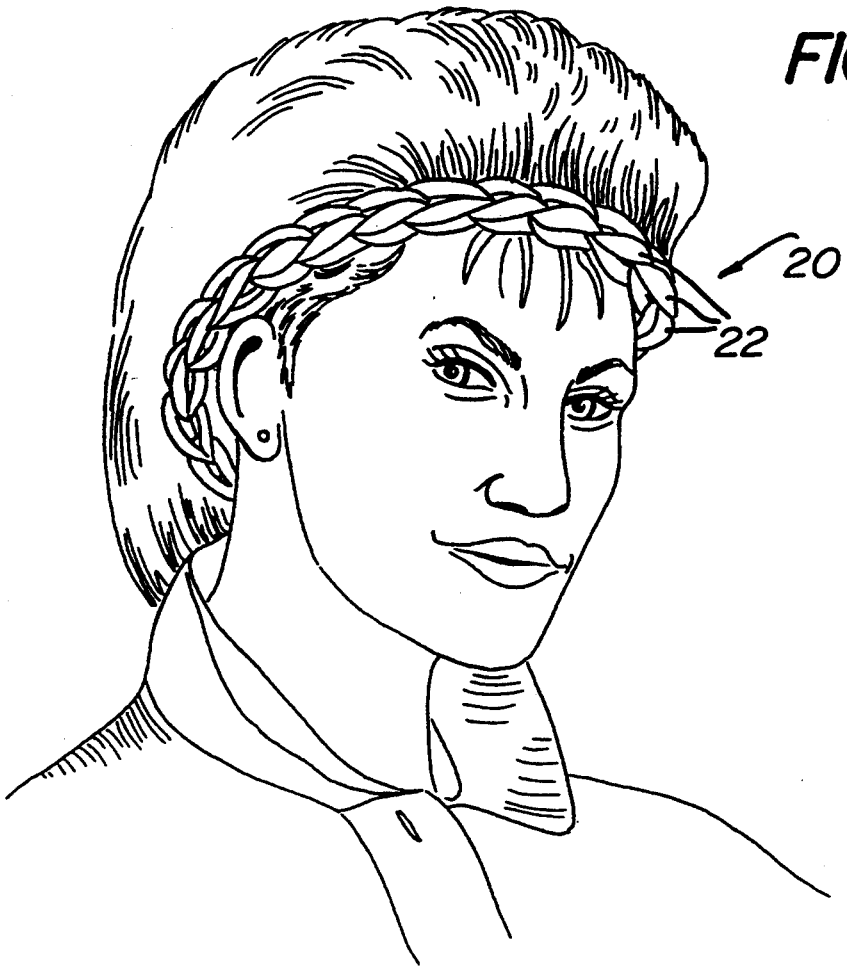
FIG. 2
FIG. 1
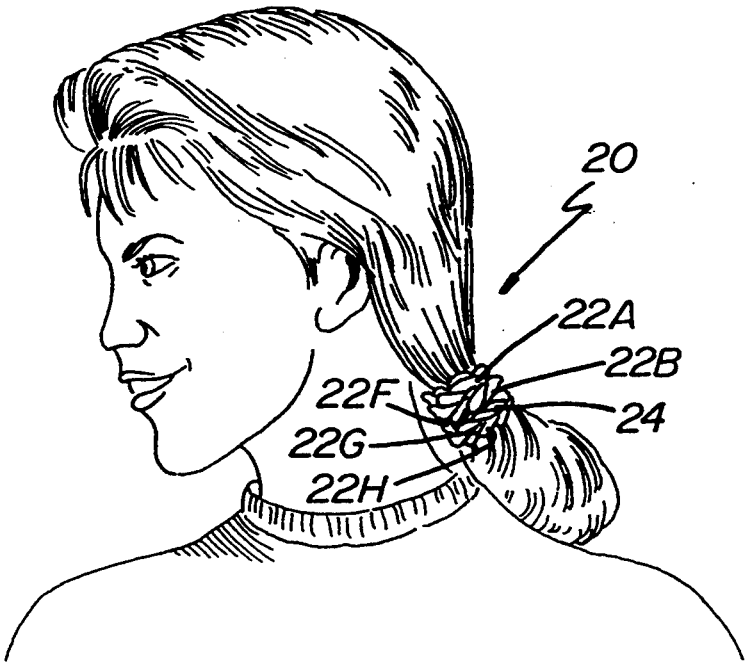

FIG. 4
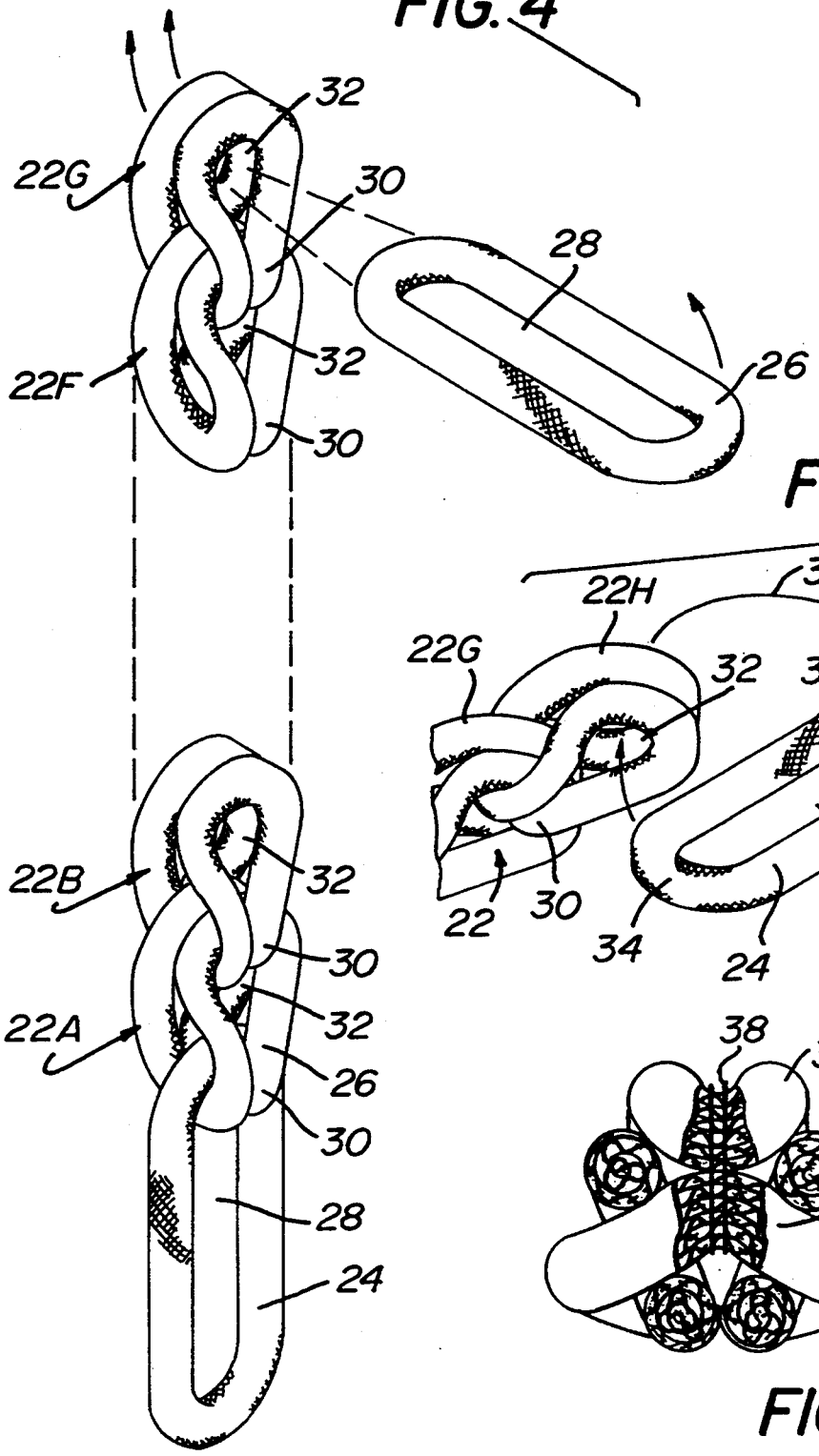
FIG. 5
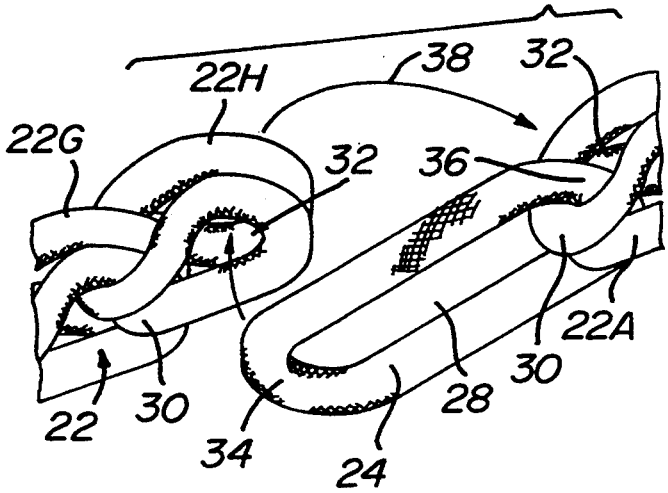
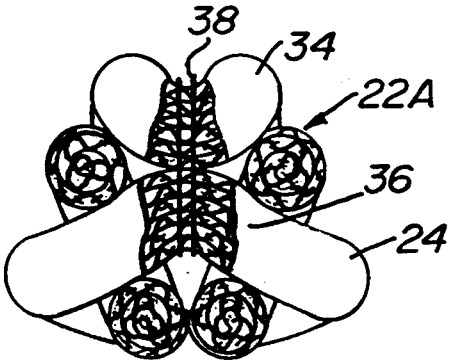
FIG. 7

RING-LIKE HEADWEAR ORNAMENT

BACKGROUND OF THE INVENTION

This invention relates generally to hair ornaments, and more particularly to devices for holding hair, e.g., a ponytail holder, or to be worn on the head as a headband or on a hat as a hat band.

Various elastic rings are commercially available for use as ponytail holders and some are the subject of United States Letters Patent. For example in U.S. Pat. No. 292,030 (Revson) there is shown a gathered fabric ring for holding a pony tail. Commercially available devices bearing that patent number are constructed utilizing a generously sized ring of a decorative fabric and having an elastic ring disposed therein to cause the fabric ring to gather into many folds. Resulting ring can then be used directly or twisted up into a "figure 8" configuration to hold strands of gathered hair, e.g., a ponytail.

In U.S. Pat. No. 5,156,171 (Goodman) there is disclosed a ponytail holder which is formed of a relatively wide fabric ring having a tubular annulus around a central hole, and an elastic ring having a portion that is readily grasped, as by having a knob, such as a bead, for pulling a loop of the elastic ring outside of the fabric ring. The fabric ring with its contained portion of the elastic ring, can encircle a pony tail once and grip the pony tail and the loop of the elastic ring outside the fabric ring can encircle the pony tail separately.

In U.S. Pat. No. 5,044,385 (Rhodes) there is disclosed a ponytail holder comprising an endless planar elastic band and at least one flattened hollow tube of a flexible material and having mutually interconnecting end edges. The flattened tube is interconnected to the elastic band along the axial length of the tube and the band while the band is in an expanded or stretched condition. The hollow tube includes radially inwardly directed cut edges extending through less than the width of the tube to form two ply radially outwardly extending members which simulate petals of a flower.

While the aforementioned patents appear generally suitable for their intended purposes, e.g., to hold the strands of hair forming a pony tail, the never the less leave something to be desired from one or more of the following standpoints, aesthetic appeal, effectiveness, ruggedness or resistance to damage from repeated usage, ease of manufacture, cost.

Hence, a need presently exists for a hair/head ornament which address those deficiencies of the prior art.

OBJECTS OF THE INVENTION

Accordingly, it is a general object of this invention to provide a hair/head ornament which overcomes the disadvantages of the prior art.

It is a further object of this invention to provide a hair/head ornament which is aesthetically pleasing.

It is still a further object of this invention to provide a hair/head ornament which is easy to make.

It is still a further object of this invention to provide a hair/head ornament which can be manufactured at a relatively low cost.

It is yet a further object of this invention to provide a hair/head ornament which is of rugged construction to be resistant to damage from repeated usage.

SUMMARY OF THE INVENTION

These and other objects of this invention are achieved by providing a ring-like ornament, e.g., a hair band, headband, hat band, etc., for wearing on a portion of a person and a method of making the ornament.

The ornament comprises a plurality of looped links and a looped connecting member. Each of the looped links is formed of an flexible, somewhat elastic material in the nominal shape of a loop but bent into a shape having a bridging midsection and a pair of openings on each side of the bridging midsection. The looped connecting member is in the form of a loop having a central opening.

The looped links are interconnected with one another so that the bridging midsection of one looped link extends through the openings in the immediately adjacent looped link to form an elongated chain-link strip having a pair of ends. One of the ends of the chain-linked strip comprises the looped connecting member. The other of the ends of the strip comprises a pair of openings of the looped link forming that other end.

The looped connecting member is bent into a shape having a free end which is extended through the openings of the looped link forming the other of the ends of the chain-linked strip and is bent over itself and secured by securement means to another portion of it to connect the ends of the chain-link strip and thereby form a ring-like ornament and so that the looped connecting member is shaped to simulate the shape of the looped links.

The method of the making the ornament entails providing a looped connecting member and a plurality of looped links formed of an flexible, somewhat elastic material in the nominal shape of a loop. The looped connecting member has a central opening and is formed of the same material as the looped links. The looped links are connected together by supporting the looped connecting member, squeezing a first looped link together to flatten it somewhat and passing the flattened first looped link within the central opening of the looped connecting member. Then the first looped link is opened within the looped connecting member in a manner so that the first looped link includes a bridging midsection extending through the central opening in the looped connecting member and a pair of end openings extending outside of the looped connecting member. Then a second looped link is squeezed together to flatten it somewhat and the flattened second looped link is passed within the extending end openings of the first looped link. This procedure is continued until a predetermined number of looped links are connected together to form a chain-link strip.

The chain-linked strip has a first end defined by the looped connecting member and a second end defined by a looped link having a bridging midsection and a pair of end openings.

The looped connecting member is then grasped to flatten a portion of it and to extend the flattened portion of it through the end openings of the looped link forming the second end of the chain-linked strip. The flattened portion of the looped connecting member is bent over itself and secured to the portion thereof which extends through the end openings of the first looped link. This action thereby interconnects the linked loops and forms a closed ring while causing the looped connecting member to simulate the appearance of the looped links of the ring, so that the entire ring looks like it is formed of serially connected looped links.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is an isometric view of a person wearing a ponytail holder embodiment of an ornament constructed in accordance with this invention;

FIG. 2 is an isometric view of a person wearing a head band embodiment of an ornament constructed in accordance with this invention;

FIG. 4 is an enlarged exploded isometric view showing a portion of the procedure entailed in the making of the ornaments of FIGS. 1 and 2;

FIG. 5 is an enlarged isometric view showing another portion of the procedure for making the ornaments of FIGS. 1 and 2;

FIG. 7 is a sectional view taken along line 7—7 of FIG. 1.

DETAILED DESCRIPTION OF THE PREFERRED EMBODIMENTS

Figure 3:
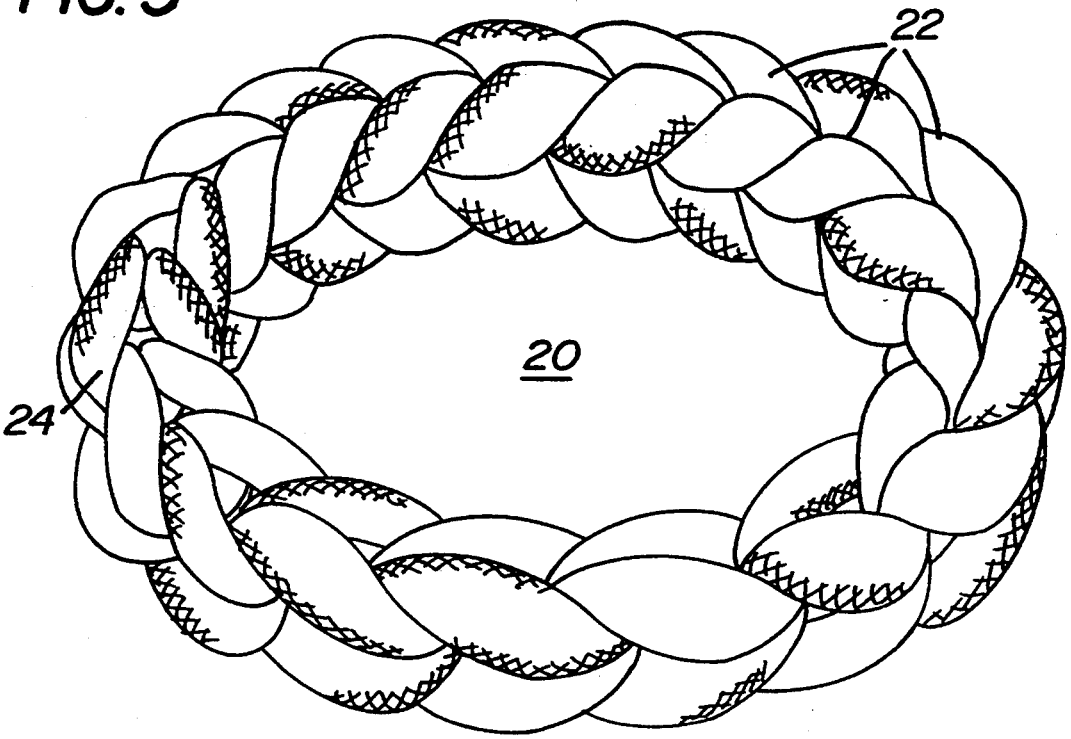
FIG. 3 is an enlarged isometric view of the embodiment of the ornament shown in FIG. 2.
Figure 6:
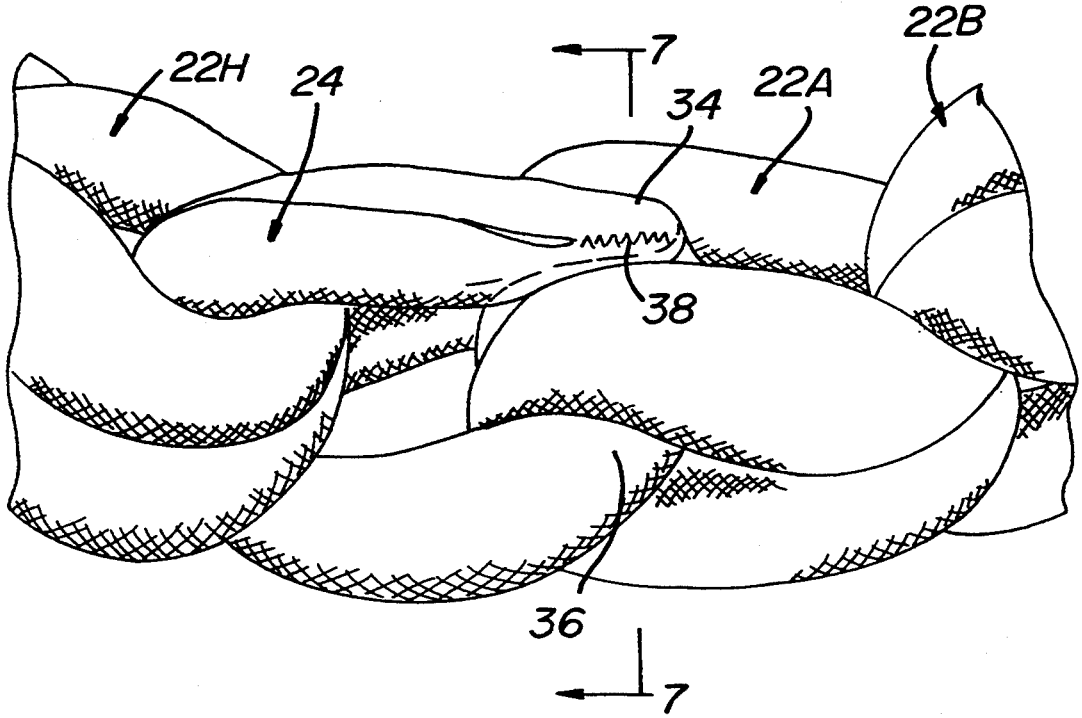
FIG. 6 is an enlarged isometric view of a portion of the ornaments shown in FIGS. 1 and 2.

Referring now to various figures of the drawing where like reference numerals refer to like parts there is shown at 20 in FIG. 1, a ring-like ornament for use on the head of a person constructed in accordance with the subject invention. Depending upon the size the ornament 20 can be used as a hair, e.g., pony tail holder (FIG. 1), a head band (FIG. 2), a hat band (not shown), or any other decorative object worn on the head or on a hat.

The ornament 20 basically comprises a plurality of identical looped links 22 (FIGS. 1 and 2) and a connecting loop 24 (FIGS. 1 and 7). In the pony tail holder embodiment of FIG. 1 the ornament comprises eight links 22A–22H and a connecting loop 24. The looped links 22A–22H are interconnected, as will be described later, to form a chain-linked strip, having a pair of ends which are connected together by the connecting loop 24 to close the ring. In the head band or hat band embodiment significantly more looped links 22. Thus, as can be seen in FIGS. 2 and 3 the head band embodiment includes 17 looped links and one connecting loop (although more or less looped links can be used, depending upon the size desired—as will be described later).

Each of the looped links 22 and the connecting loop 24 of each ornament is formed of a flexible, somewhat stretchable material. Moreover, all of the looped links and the connecting loop may be formed of the same material, having the same color and texture, or may be formed of different materials/colors/textures, depending upon the aesthetics desired. In some preferred embodiments the looped links and connecting loop are formed of identically sized loops of a knitted fabric, which may be of the same color or different colors etc. The loops are preferably formed by taking an elongated tube of knitted material of a predetermined inside diameter, e.g. 2 inches (5.08 cm), severing transverse sections of a predetermined width, e.g., 1 inch (2.54 cm), therefrom, and rolling each of the sections up to form plural toroidal shaped loops 26 (See FIG. 4) of approximately 2 inch (5.08 inside diameter).

A first of the toroidal shaped loops 26 makes up the heretofore identified connecting loop 24, while other toroidal shaped loops make up the looped links of the ornament. Thus, for the pony tail holder of FIG. 1 eight toroidal shaped loops are used to make up the looped links 22A–22H. It should be pointed out at this juncture that the ornament shown herein, with eight looped links 22A–22H, and one connecting loop 24 (which is bent into a shaped simulating a looped link—as will be described later) is only exemplary. Thus, the size and number of looped links which are used in an ornament 20 of this invention is a function of the desired diameter of the ornament. When an ornament is formed using eight looped links 22A–22H, and one connecting loop, each formed of toroidal loops of the exemplary size set forth above, the resulting "nine loop ornament" has an unstretched inside diameter of approximately 1.25 inches (3.18 cm).

Reference should now be made to FIGS. 4–7 to understand the manner in which the ornament is made. Thus, to make the ornament 20 the connecting loop 24 is supported by hand (or by some mechanical means) and a second toroidal loop 26 is connected to it to form the first looped link 22A. In particular, the second toroidal loop 26 is squeezed together to flatten it somewhat. This flattened loop is then passed through the central opening 28 of the looped connecting member 24. Then the ends of the flattened second toroidal loop 26 are opened while its mid-portion is within the opening 28 of the looped connecting member 24 so that the second toroidal loop 26 is in a configuration having a bridging midsection 30 and a pair of end openings 32, with the bridging midsection 30 extending through the opening 28 in the looped connecting member 24 and the end openings 32 being axially aligned with each other and located outside of the looped connecting member 24.

As should be appreciated by those skilled in the art this action forms the second toroidal loop into the first looped link 22A.

After the first looped link 22A is formed (and connected to the connecting loop 24) a third toroidal loop 26 is squeezed flat and inserted through the axially aligned extending end openings 32 of the first looped link 22A. The third toroidal shaped loop 26 is then opened so that it is in the same configuration as the first looped link 22A, to thereby form the third toroidal loop into the second looped link 22B. This procedure is then repeated to form and connect the remaining looped links 22C–22H of the ornament 20.

Once the last looped link, e.g., 22H, has been formed the resulting construction will be in the form of an elongated chain-linked strip having a first end defined by the connecting loop 24 and a second end defined by the last of the looped links, i.e., 22H, as shown in FIG. 5.

In order to complete the ornament the elongated strip is rolled into a ring, bringing its two ends in close proximity to each other as shown in FIG. 5. Then the looped connecting member 24 is grasped, either by hand or by machine, to flatten it so that it has a free end 34 disposed opposite to the end 36 to which the first looped link 22A is secured. The flattened free end portion 34 of the connecting member 24 is then extended through the axially aligned end openings 32 of the looped link 22H which forms the opposite end of the chain-linked strip. Then the flattened portion free end portion 34 of the looped connecting member 24 is bent back over itself in the direction of arrow 38 and into engagement with its end portion 36 and is secured thereto by any suitable means. In the embodiment shown herein the securement is by one or more stitches 38 and/or an adhesive (not shown). As shown clearly in FIG. 7 this action forms the connecting loop 24 into a configuration which simulates the appearance of a looped link and closes ring, thereby completing the ornament. The resulting ring-like ornament will have the appearance of an unbroken chain-link since each of the members making it up will exhibit the same general appearance.

The ornament 20 can be used in any suitable manner. For example, a "nine looped ornament" like the exemplary one described above, can be doubled up, i.e., bent into the shape of a "figure 8" and flattened so that it forms a double ring of smaller diameter. This arrangement is shown in FIG. 1 and is particularly suitable for holding a small bunch of hair, e.g., a pony tail, together. For larger bunches of hair, the ornament 20 can be used directly without doubling it up. When the ornament is to be used as a headband or hat band it is can be used either singly, doubled, tripled, etc., depending upon the number and size of the looped members making it up.

In the interests of aesthetic appeal the ornament may be provided with decorative ornamentation on component members. Such ornamentation can take various forms, e.g., beads, jewels, pins, etc.

It should be pointed out at this juncture that other material than the disclosed knitted fabrics can be used for forming the looped links and connecting loop. In fact, the material forming those members need not be a fabric at all, so long as it is somewhat elastic so that when formed into a loop or band it is can be stretched and twisted or bent. Moreover, the members forming the looped links and the connecting loop need not be toroidal, nor need they be fabricated as described above.

It should also be pointed out the connector loop can be secured to itself in various other manners than adhesives or stitching 38 so that it closes the ring-like ornament and simulates a looped link.

Without further elaboration the foregoing will so fully illustrate my invention that others may, by applying current or future knowledge, adapt the same for use under various conditions of service.

I claim:

1. A ring-like ornament for wearing on a portion of a person comprising a plurality of looped links and a looped connecting member, said looped connecting member comprising a loop of a somewhat elastic material and having a central opening therein, each of said looped links being formed of an flexible, somewhat elastic material in the nominal shape of a loop but bent into a shape having a bridging midsection and a pair of openings on each side of the bridging midsection, said looped links being interconnected with one another so that the bridging midsection of one looped link extends through the openings in the immediately adjacent looped link to form an elongated chain-link strip having a pair of ends, one of said ends of said chain-linked strip comprising said looped connecting member, the other of said ends of said strip comprising a pair of openings of the looped link forming that other end, said looped connecting member being bent into a shape having a free end which is extended through the openings of the looped link forming the other of the ends of the chain-linked strip and is bent over itself and secured by securement means to another portion of the looped connecting member to connect the ends of the chain-link strip and thereby form a ring-like ornament, and with the looped connecting member being shaped to simulate the shape of the looped links.

2. The head ornament of claim 1 wherein said looped links and said looped connecting member are each formed of an elastic fabric.

3. The head ornament of claim 2 wherein said elastic fabric is knitted.

4. The head ornament of claim 1 wherein said securement means comprises an adhesive.

5. The head ornament of claim 1 wherein said securement means comprises at least one stitch.

6. The head ornament of claim 1 wherein said looped links are all of the same color.

7. The head ornament of claim 1 wherein said looped links comprises plural colors.

8. The head ornament of claim 1 wherein said ring can be configured for holding strands of hair therein.

9. The method of claim 1 wherein said looped links are each formed of a loop of fabric and wherein said looped connecting member is formed of a loop of the same fabric.

10. The method of claim 9 wherein said loop of fabric is initially in the form of a tube which is severed to form plural loops of fabric.

11. The method of claim 10 wherein each of said plural loops of fabric is rolled up to form an toroidal shaped member.

12. The method of claim 9 wherein said fabric is knitted.

13. The method of claim 9 wherein said fabric is of the same color.

14. The method of claim 9 wherein said fabric is of different colors.

15. A method of forming a ring-like ornament for wearing on a portion of a person comprising a plurality of looped links and a looped connecting member shaped like said looped links, said method comprising providing a plurality of looped links formed of a flexible, somewhat elastic material in the nominal shape of a loop, providing a looped connecting member having a central opening and being formed of the same material as the looped links, interconnecting said looped links together by supporting said looped connecting member, squeezing a first looped link together to flatten it somewhat and passing the flattened first looped link within the central opening of the looped connecting member, opening the first looped link within said looped connecting member in a manner so that the first looped link includes a bridging midsection extending through the central opening in the looped connecting member and a pair of end openings extending outside of the looped connecting member, squeezing a second looped link together to flatten it somewhat and passing the flattened second looped link within the extending end openings of the first looped link, continuing said procedure until a predetermined number of looped links are connected together to form a chain-link strip, said chain-linked strip having a first end defined by said looped connecting member and a second end defined by a looped link having a bridging midsection and a pair of end openings, grasping said looped connecting member to flatten a portion of it and extending said flattened portion of the looped connecting member through the end openings of the looped link forming the second end of the chain-linked strip, and then bending said flattened portion of the looped connecting member over itself and securing said flattened portion of the looped connecting member to the portion thereof which is extending through the end opening of the first looped link to thereby interconnect the linked loops and form a closed ring and cause the looped connecting member to simulate the appearance of the looped links of the ring.

16. The method of claim 15 wherein the securing of the portions of the looped connecting member together is effected by use of an adhesive.

17. The method of claim 15 wherein the securing of the portions of the looped connecting member together is effected by use of at least one stitch.

* * * * *